United States Patent [19]

Wright

[11] Patent Number: 4,531,659

[45] Date of Patent: Jul. 30, 1985

[54] FOAM DISPENSING DEVICE AIR RETURN SYSTEM

[76] Inventor: Hershel E. Wright, P.O. Box 51, Decatur, Ill. 62525

[21] Appl. No.: 604,125

[22] Filed: Apr. 25, 1984

Related U.S. Application Data

[63] Continuation of Ser. No. 352,936, Feb. 26, 1982, abandoned.

[51] Int. Cl.[3] ..... F04C 1/14

[52] U.S. Cl. ..... 222/190; 222/211; 239/343

[58] Field of Search ..... 222/189, 190, 211, 212, 222/481, 482; 239/327, 343, 353, 354

[56] References Cited

U.S. PATENT DOCUMENTS

| | | | |
|---|---|---|---|
| 2,738,105 | 3/1956 | Wolfer et al. | 222/481.5 X |
| 3,257,046 | 6/1966 | Kasson | 222/490 |
| 3,622,049 | 11/1971 | Thompson | 222/190 |
| 3,937,364 | 2/1976 | Wright | 222/211 X |
| 3,973,701 | 8/1976 | Gardner | 222/190 |
| 4,024,992 | 5/1977 | Schmid | 222/211 |
| 4,122,979 | 10/1978 | Laauwe | 222/211 X |
| 4,184,615 | 1/1980 | Wright | 222/190 |
| 4,429,834 | 2/1984 | Ito | 222/190 X |

FOREIGN PATENT DOCUMENTS

| | | | |
|---|---|---|---|
| 1213111 | 11/1970 | United Kingdom | 239/327 |

*Primary Examiner*—Joseph J. Rolla
*Assistant Examiner*—Michael S. Huppert
*Attorney, Agent, or Firm*—Cohn, Powell & Hind

[57] ABSTRACT

This foam dispensing device intended for use in the inverted position includes a container for holding foamable liquid and having a foam producing unit mounted in the discharge port. The foam producing unit includes a closure having separate air inlet and foam outlet openings. An elongate air return tube having a one-way valve is connected to the air inlet and a foam producing system is provided having an elongate air supply tube.

9 Claims, 7 Drawing Figures

FOAM DISPENSING DEVICE AIR RETURN SYSTEM

This application is a continuation of application Ser. No. 352,936, filed Feb. 26, 1982, now abandoned.

BACKGROUND OF THE INVENTION

The invention relates generally to non-aerosol, foam dispensing devices and particularly to a foam dispensing device which contains a separate air return system and which can be used in the inverted position.

Several patents have been issued for squeeze bottle type foam dispensing devices, in which foam is formed by mixing air and foamable liquid. Several of these devices are intended for use in the inverted condition and examples of such patents are U.S. Pat. No. 3,422,993, issued to G. L. Boehm and U.S. Pat. Nos. 3,709,437, 3,937,364 and 4,022,351 issued to H. E. Wright. In the Boehm patent no specific provision is made for the return of air into the unit. In two of the Wright patents namely U.S. Pat. Nos. 3,937,364 and 4,022,357 a valved air return system is disclosed in which a ball check valve is provided in the same conduit through which the formed foam is dispensed. In U.S. Pat. No. 4,022,351 an interior bag is used to entrap the air and keep it separate from the liquid. U.S. Pat. No. 3,622,049, issued to R. E. Thompson discloses a foaming device which has a separate air return but utilizes only a single dip tube.

In the case of the Boehm patent an air return into the inverted foam dispenser tends to cause foaming internally in the squeeze bottle container. The air return is slow and the unit tends to become inoperative after several squeezes because of the internal formation of foam which occupies the air space needed to produce foam.

In the Wright Patent, U.S. Pat. No. 3,937,364 the air return problem is solved to some extent. However, in order to produce an effective device the return tube must be of sufficient diameter to facilitate the flow of return air. A disadvantage of providing a relatively large diameter return air conduit is that liquid tends to migrate into the conduit when the foam dispensing device is stored in the upright position. The result is that when the unit is inverted for use the explusion of this liquid tends to create a "wet" shot. This problem is overcome in the Wright patent, U.S. Pat. No. 4,022,351 but requires the provision of an internal air bag.

The present invention solves these and other problems in a manner not disclosed in the known prior art.

SUMMARY OF THE INVENTION

This foam producing device includes a separate air return system which facilitates the return of air into the container. In particular, the provision of separate elongate air return and elongate foam forming conduits makes the dispensing device particularly adaptable for use in the inverted position and permits the use of a relatively large air return conduit to facilitate the supply of return air and the use of a relatively small foam forming supply conduit to minimize the likelihood of a "wet" shot. The provision of a separate air return system also permits the use of a long nozzle for insertion into cavities in those instances in which the provision of a return air supply through the long nozzle is not practical and it is therefore necessary to locate the return air source outside the cavity. This feature is particularly advantageous in expediting surgical techniques by facilitating vaginal preparation, for example.

This foam dispensing device includes a container for holding foamable liquid having a discharge port and a foam producing unit mounted to the container and separating the area adjacent the discharge port and the interior of the container. The foam producing unit includes a closure for the container having air inlet means and foam outlet means; the air return means communicates with the air inlet means and includes an elongate, inwardly extending conduit having an opening communicating with the interior of the container; valve means is provided closing the air return means when pressure is applied to the container and opening the air return means when the pressure applied to the liquid is relieved; and foam producing means is also provided communicating with the foam outlet means and including a second, elongate, inwardly extending conduit having an opening communicating with the interior of the container.

It is an aspect of this invention to provide that the elongate air return conduit has a diameter greater than that of the elongate foam producing means conduit.

Yet another aspect of this invention is to provide that the valve means is disposed at the outer end of the air return means.

Yet still another aspect of this invention is to provide that the valve means is disposed at the inner end of the air return means.

It is another aspect of this invention to provide that the valve means includes an elongate flexible cap member having at least one selectively openable longitudinal slit which responds to the applied pressure within the container.

Still another aspect of this invention is to provide that the closure includes an elongate nozzle providing a remote foam outlet means, and to provide that the air inlet means is disposed inwardly of the foam outlet means.

DESCRIPTION OF THE PREFERRED EMBODIMENT

Figure 1:
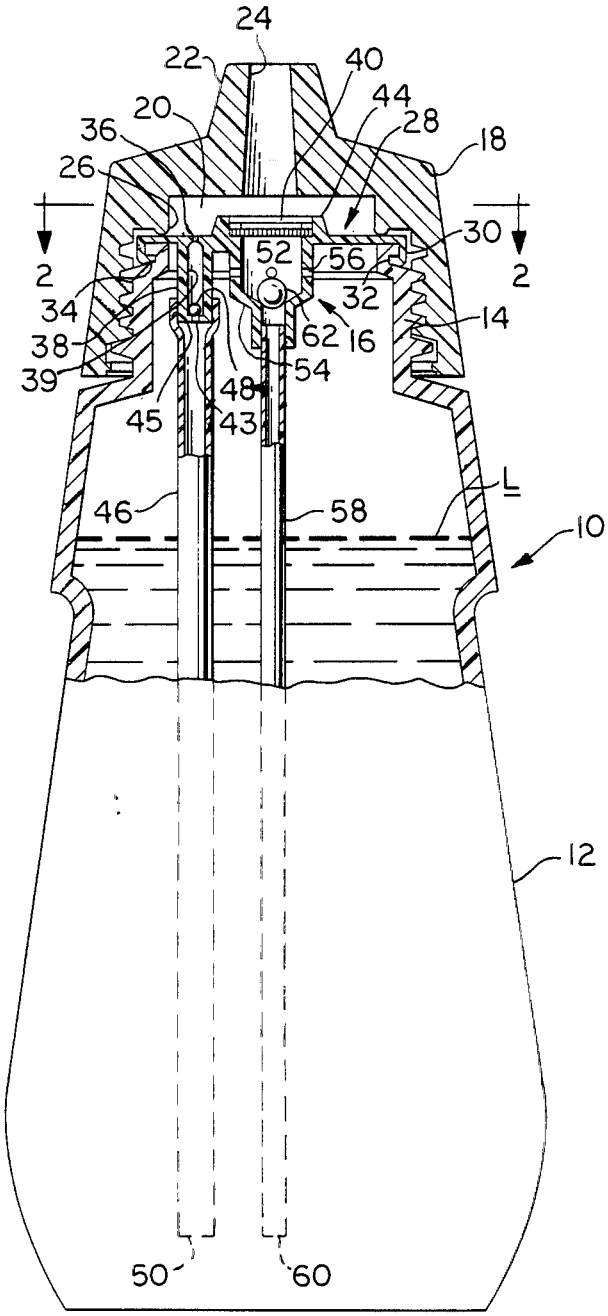
FIG. 1 is an elevational view, partially in cross-section, of the foam dispensing device in the upstanding position.
Figure 2:
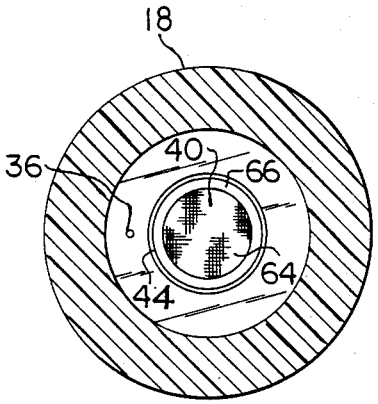
FIG. 2 is a sectional plan view taken on line 2—2 of FIG. 1.

Referring now by reference numerals to the drawings and first to FIG. 1 it will be understood that the foam dispensing device, generally indicated by numeral 10, includes a container 12 having a neck portion 14 defining a discharge port. The device also includes a foam producing unit generally indicated by numeral 16 and a cap 18, which is threadedly engageable with the neck portion 14 of the container 12. The cap 18 provides an annular chamber 20 and a nozzle 22 defining a passage 24 communicating with said chamber 20. The cap also includes an annular rib which is engageable with the foam producing unit 16.

The container 12 in the preferred embodiment is a manually operated squeeze bottle and provides a reservoir for foamable liquid, generally indicated by L, and may be formed from any suitable deformable material such as plastic.

The foam producing unit 16 includes a closure 28 having a depending flange 30 provided with a circular lip 32 which is received in snap-fitted relation within a corresponding container groove 34. The closure 28 includes an offset opening 36, defined by a passage 38, and a central opening 40, defined by an annular rib 44, which constitutes a foam outlet means. The air inlet opening 36 communicates with an air return means which includes the passage 38 provided by a short tubular member 39, and an elongate, inwardly extending tubular member 46. The tubular member 39 is provided with a lower end opening 43 having projections 45 disposed thereabout and houses a ball check 48. The inwardly extending tubular member 46 provides an elongate conduit means and said member 46 includes an enlarged end portion overfitting the tubular member 39 and a lower end opening 50 communicating with the interior of the container 12. The ball check 48 cooperates with openings 36 and 44 to provide a valve means, said ball check 48 preventing air flow through the air inlet opening 36, when seated against said opening, but permitting air flow through the opening 36 when seated against the projections 45.

The central opening 40 providing the foam outlet means, communicates with a foam producing means 52 which forms part of the foam producing unit 16. In the embodiment shown, the foam producing means 52 is similar to that disclosed in U.S. Pat. No. 3,709,437 in that it includes a downwardly depending hollow element having passages 56 disposed thereabout and providing a foam producing mixing chamber. An elongate tubular member 58 providing an inwardly extending conduit means, is attached to the reduced end of the hollow tubular member 54 and communicates with said tubular member 54. The tubular member 58 also includes an opening 60 at its lower end communicating with the container 12.

Figure 3:
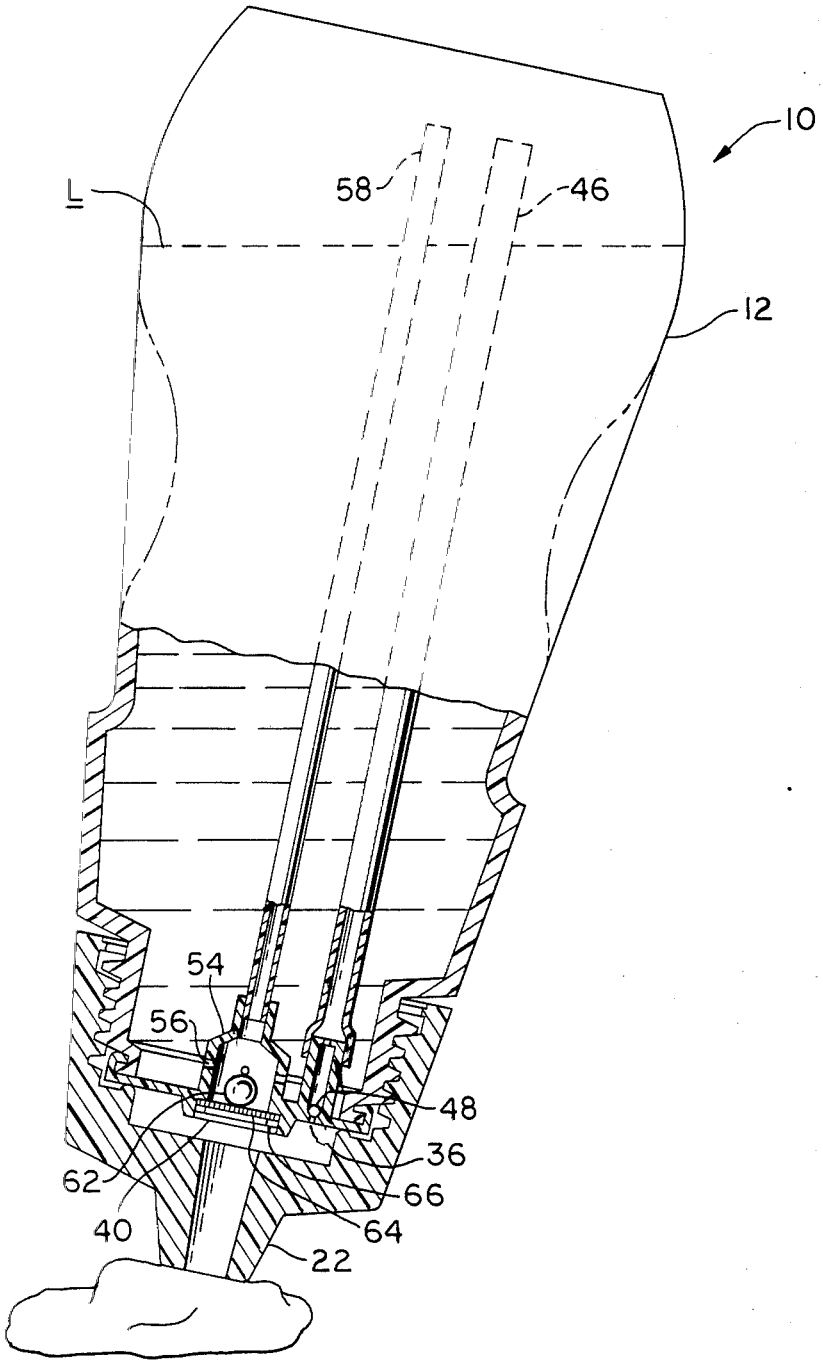
FIG. 3 is an elevational view, partly in cross-section, of the device in the inverted use position.
Figure 4:
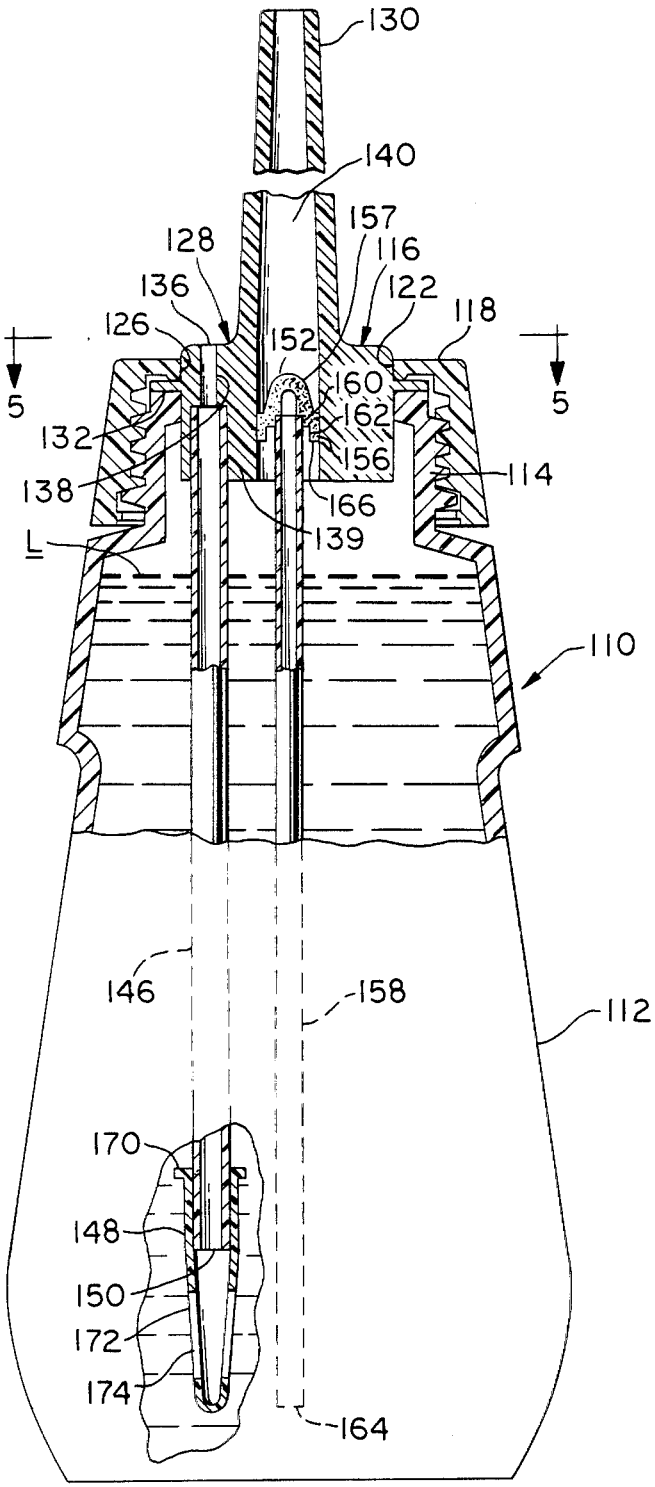
FIG. 4 is an elevational view, partly in cross-section of a modified device in the upstanding position.
Figure 5:
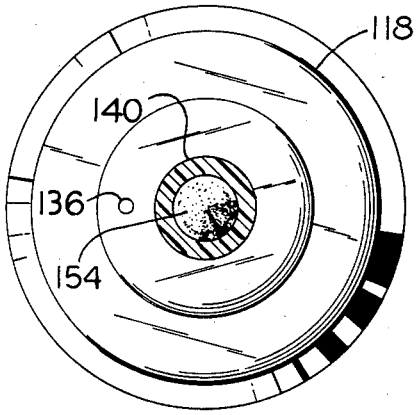
FIG. 5 is a sectional plan view taken on line 5—5 of FIG. 4.
Figure 6:
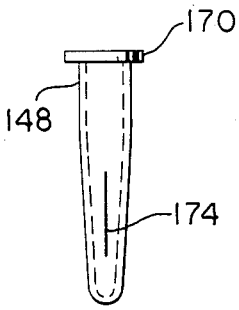
FIG. 6 is an elevational view of the flexible valve member of the modified device.

When the device is inverted, as shown in FIG. 3, passages 56 provide for the introduction of foamable liquid into the mixing chamber formed by the member 54 at the same time that air is introduced into said mixing chamber by the elongate tubular member 58. The cross section of the passages 56 and the cross section of the elongate tubular member 58 are such that flow of liquid and air respectively therethrough is restricted. When pressure is applied to the container 12, as by squeezing, the foamable liquid is forced through the passages 56 and air is forced through the tubular member 58. Simultaneous introduction of air and foamable liquid affect the intermixing of liquid and air in the mixing chamber to produce foam. In the embodiment shown, a ball check valve 62 is provided for the mixing chamber which seats within a reduced portion of the hollow element 54 to prevent the return of foam into the tubular member 58 when the container is returned to the upright position. The foam outlet opening 40 is configurated to provide a seat for a foam homogenizing overlay element 64 which is held in place by means of a retainer ring 66.

It will be understood that during the foam forming operation, when the container 12 is squeezed and pressure thereby applied to the air and liquid in the container 12, the ball check 48 prevents the movement of air or liquid through the air inlet opening 36. When pressure is relaxed, or the device is returned to the upright position the ball check 48 seats on the projections 45 to permit the return of air into the container. In the preferred embodiment, the internal diameter of the air return tubular member 46 is substantially greater than that of the foam producing supply tubular member 58. Good results have been obtained by using a tubular member 58 having an internal diameter in the range of 0.040–0.070 inches and a tubular member 46 having an internal diameter in the range of 0.090–0.150 inches.

When the foam dispensing device is in the upright position liquid will migrate into both tubular members. However, because of the use of a relatively small diameter tubular member 58 the liquid supplied through the tubular member to the foam producing means 16 is minimal. On the other hand, the relatively large diameter tubular member 46 allows fast recovery of the container 12 and any liquid in the tubular member precedes the flow of air into the container 12 when the squeeze pressure is relaxed. As will be understood tubular members 46 and 58 are of a length to extend into the air pocket above liquid L. As shown in FIGS. 1 and 3, the tubular members 46 and 58 are of substantially the same length with their lower end openings 50 and 60 located substantially adjacent to, and a substantially equal distance from, the bottom of the container 12.

A modified foam dispensing device indicated by numeral 110 is shown in FIGS. 4, 5, 6 and 7. This device is similar to device 10 discussed above in that it includes a container 112 having a neck portion 114 defining a discharge port receiving a foam producing unit 116. The foam producing unit 116 is received within the neck portion 114 and is held in place by a cap 118 threadedly engageable with the neck portion 114 and having a rib 126 engageable with a closure 128.

In the embodiment shown, the cap 118 includes a central opening 122 and the closure 128 is molded to include an elongate flexible nozzle 130 and an annular flange 132 which is disposed between the cap 118 and the neck portion 114. The closure 128 also includes an offset opening 136, defined by a passage 138, and constituting an air inlet means. A central passage 140, provided by the nozzle 130 provides a remote foam outlet means. The passage 138 is enlarged at its lower end 139 to receive an elongate tubular member 146 which extends inwardly toward the bottom of the container 112 and cooperates with the passage 138 to provide an air return means.

At its lower end the tubular member 146 is provided with a lower end opening 150 and receives an elongate valve cap member 148 of flexible material, which constitutes a valve means. The cap member 148 includes an annular flange 170 and a body portion 172 provided with a pair of elongate opposed slits 174. Because of the flexible nature of the "duckbill" cap member 148, pressure on the cap resulting from squeezing the container 112 causes the slits 174 to close thereby preventing the passage of air therethrough, whereas relative negative pressure resulting from release of the container 112 causes the slits 174 to open and admit air therethrough. As will be readily understood the nature of the slits is such that when the container 110 is in the upstanding position the tendency of foamable liquid to migrate into the tubular member 146 is reduced.

The closure passage 140 of the foam producing unit 116 communicates with a foam producing means 152, which forms part of the foam producing unit 116. In the embodiment shown, the foam producing means 152 is similar to that disclosed in U.S. Pat. Nos. 3,937,364 and 4,184,615 in that it utilizes a porous member as the foam producing means. As shown in FIG. 3, the generally conical porous member 154 includes an inner mounting portion 156, which is seated within the lower portion of the nozzle passage, and an outer portion 157. The porous member 154 is generally hollow and includes outer and inner socket portions 160 and 162 respectively. The outer socket portion 160 receives an elongate tubular member 158 which is provided with an end opening 164 communicating with the interior of the container 112. As shown, the tubular members 146 and 158 communicate with the interior of the container 112 adjacent to its bottom. The porous member 154 includes an exposed annular end surface 166 and an exposed interior wall surface is provided by the inner socket portion 162.

Figure 7:
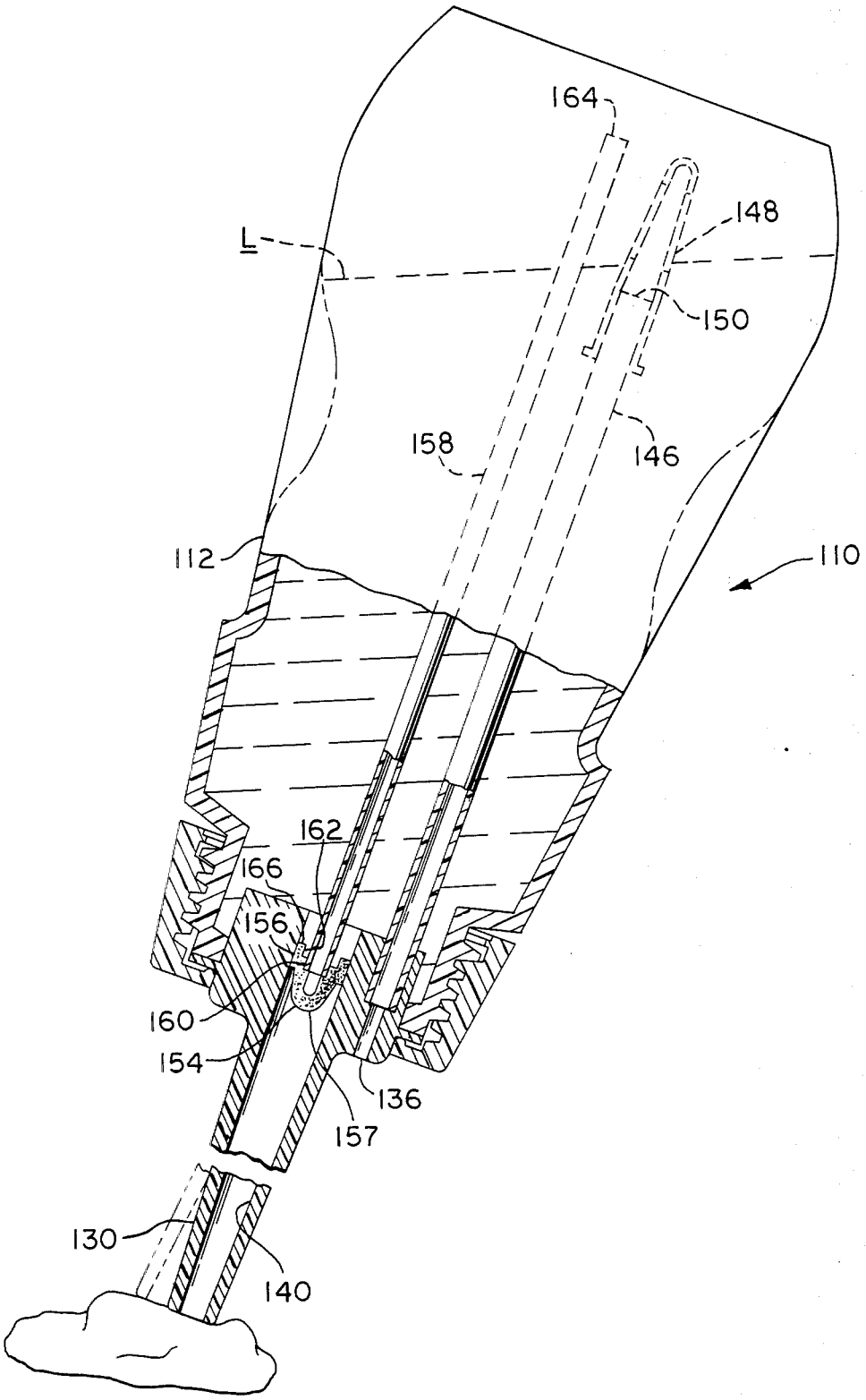
FIG. 7 is an elevational view, partly in cross-section of the modified device in the inverted use position.

The foam dispensing device 110 is inverted for use in the same manner as the foam dispensing device 10. As shown in FIG. 7 when the container 112 is deformed, as by squeezing, the increase of pressure within the container causes liquid to be forced into the exposed surfaces 162 and 166 of the porous member 154 while air is forced down the tubular member 158. Foamable liquid received by the exposed porous surfaces is intermixed with air within the porous member 154 to form foam which is discharged from the porous member outer portion 157, said outer portion being provided with a foam discharging area greater than the cross-sectional area of the porous member in the vicinity of the mounting portion 156. Increased pressure on the valve cap member 148 effectively seals the tubular member 146 until the internal pressure within the container is relieved by manually releasing the pressure on the container at which time the valve action is reversed and air is permitted to enter the container through the air inlet opening 136.

The length and flexibility of the nozzle 130, typically four to six inches long and formed from synthetic rubber, or similar plastic material, facilitates insertion of the nozzle into body cavities to deposit medicinal foam. Further, the provision by the nozzle 130 of a remote foam outlet means and the provision of an air inlet opening 136 deposed inwardly of the nozzle end, relative to the container 112, facilitates intake of air without requiring removal of the nozzle from the body cavity.

In the embodiment shown, the internal diameter of the air return tubular member 146 is substantially greater than that of the foam producing supply member 158 and said tubular members are of generally the same length to extend into the air pocket and are of the same diameter as for the first device 10 discussed above.

It will be understood that although specific foam producing means have been shown in the two devices discussed above neither device is limited to a particular foam producing means. By the same token each device can be adapted to suit either one of the air return systems.

I claim as my invention:

1. A foam dispenser device, comprising:

(a) a container for holding foamable liquid having a discharge port and a bottom, and (b) a foam producing unit mounted to the container and separating the area adjacent the discharge port and the interior of the container, said foam producing unit including:

(1.) a closure means for the container having air inlet means and foam outlet means, (2.) air return means communicating with the air inlet means and including an elongate, inwardly extending conduit having an opening communicating with the interior of the container, (3.) valve means closing the air return means when pressure is applied to the container and opening the air return when the pressure applied to the container is relieved, (4.) foam producing means communicating with the foam outlet means and including an elongate inwardly extending conduit having an opening communicating with the interior of the container said foam producing means further including at least one additional opening communicating with the interior of the container, and (5.) the air return conduit and the foam producing means conduit being of a length so that when the container is inverted the openings of each conduit communicating with the interior of the container are disposed in the air space adjacent to the container bottom whereby foam may be dispensed when the container is in the inverted position.

2. A foam dispensing device as defined in claim 1, in which:

(c) the elongate air return conduit extending into the air space when the container is inverted has an internal diameter greater than that of the elongate foam producing means conduit.

3. A foam dispensing device as defined in claim 1, in which:

(c) the air return means conduit and the foam producing means conduit are of substantially the same length and valve means is disposed at the outer end of the air return means.

4. A foam dispensing device as defined in claim 1, in which:

(c) the valve means is disposed at the inner end of the air return conduit substantially adjacent the inner end of the foam producing means conduit.

5. A foam dispensing device as defined in claim 4, in which:

(d) the air return means conduit and the foam producing means conduit are of substantially the same length and the valve means includes an elongate flexible cap member having at least one selectively openable longitudinal slit which responds to the pressure applied to the liquid.

6. A foam dispensing device as defined in claim 1, in which:

(c) the closure means includes an elongate flexible nozzle providing a remote foam outlet means, and (d) the air inlet means is disposed inwardly of the foam outlet means.

7. A foam dispensing device as defined in claim 2, in which:

(d) the internal diameter of the elongate air return conduit is in the range of 0.090–0.150 inches, and the internal diameter of the elongate foam producing means conduit is in the range of 0.040–0.070 inches.

8. A foam dispenser device, comprising:

(a) a container for holding foamable liquid having a discharge port and a bottom remote from the discharge port, and (b) a foam producing unit mounted to the container and separating the area adjacent the discharge port and the interior of the container, said foam producing unit including:

(1.) a closure means for the container having air inlet means and foam outlet means said closure means including an elongate flexible nozzle providing a remote foam outlet means and said air inlet means being disposed inwardly of the foam outlet means, (2.) air return means communicating with the air inlet means and including an elongate, inwardly extending conduit having an opening communicating with the interior of the container adjacent to the bottom of the container, (3.) valve means closing the air return means when pressure is applied to the container and opening the air return when the pressure applied to the container is relieved, and (4.) foam producing means communicating with the foam outlet means and including an elongate inwardly extending conduit having an opening communicating with the interior of the container said foam producing means further including at least one additional opening communicating with the interior of the container, said foam producing means conduit having a length substantially the same as that of the air return means conduit and an internal diameter substantially less than that of the air return means conduit whereby foam may be dispensed when the container is in the inverted position.

9. A foam dispensing, comprising:

(a) a container for holding foamable liquid having a discharge port and a bottom remote from the discharge port, (b) foam outlet means for the container communicating with the interior of the container, (c) a foam producing means mounted to the container and separating the foam outlet means and the interior of the container and including at least one opening communicating with the interior of the container, (d) a conduit extending from the foam producing means to the container interior and having an opening communicating with the interior of the container and located adjacent to the container bottom, (e) air inlet means for providing air to the interior of the container, (f) air return means communicating with the air inlet means and including a conduit having an opening communicating with the interior of the container and located adjacent to the bottom of the container, (g) valve means closing the air return means when pressure is applied to the container and opening the air return means when the pressure applied to the container is relieved, and (h) the foam producing means conduit and the air return means conduit cooperating whereby foam is produced when the container is in the inverted condition.

* * * * *